US005558522A

United States Patent [19]

Dent

[11] Patent Number: 5,558,522

[45] Date of Patent: Sep. 24, 1996

[54] SLOT MANIFOLD FOR MOTHERBOARD THAT PROVIDES SPACE-SAVING ACCESS TO AN EXPANSION BUS OF A PERSONAL COMPUTER

[75] Inventor: David Dent, Beaverton, Oreg.

[73] Assignee: Intel Corporation, Santa Clara, Calif.

[21] Appl. No.: 380,046

[22] Filed: Jan. 30, 1995

[51] Int. Cl.[6] ..... H01R 9/09

[52] U.S. Cl. ..... 439/65; 439/74; 361/785

[58] Field of Search ..... 439/65, 59, 74, 439/326, 327, 654; 361/736, 741, 744, 784, 785, 680, 684, 791, 801, 802, 803

[56] References Cited

U.S. PATENT DOCUMENTS 5,119,273 6/1992 Corda ..... 439/65

5,301,089 4/1994 Takashima ..... 361/744

*Primary Examiner*—Gary F. Paumen

*Assistant Examiner*—T. C. Patel

*Attorney, Agent, or Firm*—Owen L. Lamb

[57] ABSTRACT

A manifold expansion card connector on the motherboard of a personal computer. The computer connector comprises a base, there being a number of pins in the base. An upper portion has three sockets, each socket having connectors therein that are connected to the pins. A first socket is oriented in a plane horizontal to the plane of the pins. A second socket is oriented in a plane vertical to the plane of the pins. A third socket is oriented in a plane at an angle, such as 45 degrees, to the plane of the pins. Two of the connectors placed side by side provide for six add-in cards in a computer that has two different buses, such as a PCI bus and an ISA bus. In a computer with a single bus, such as a PCI bus or an ISA bus, a single manifold expansion card connector provides for seven cards with a single multi-pin connector to the bus.

38 Claims, 4 Drawing Sheets

SLOT MANIFOLD FOR MOTHERBOARD THAT PROVIDES SPACE-SAVING ACCESS TO AN EXPANSION BUS OF A PERSONAL COMPUTER

BACKGROUND OF THE INVENTION

1. Field of the Invention

The present invention is related to personal computers and more particularly to an apparatus that provides expansion card slots on a motherboard of a computer.

2. Background Art

A personal computer is a stand-alone desktop computer housed in a chassis which is a cover that protects the computer components from the environment and the environment from the computer, such as electromagnetic interference (EMI). Input/output (I/O) devices, such as a video monitor, mouse and printer are connected to a back panel of the chassis by means of cables that plug into connectors at a back panel of the chassis. Inside the chassis is a system board, called a motherboard, that holds the electronic components of the computer.

In past designs, up to eight receptacles (slots) are provided for adapter boards that allow compatible circuit boards (cards) to be added to the computer to expand the computer's capability. The eight slot connectors provide for user expansion to add features, such as sound capability, fax and modem communication capability, by add-in cards that have these features on them. The expansion add-in adapter cards are inserted into one or more of the eight slots which include eight connectors (sockets) that are mounted and soldered directly on the motherboard. The motherboard has printed circuit wiring that distributes the I/O signals from the add-in cards to appropriate components on the motherboard via an expansion bus. The expansion bus is an extension of the computer's address and data bus.

The prior art has the advantage that the add-in cards are easy to install by even novice users. But, the prior art requires multiple connectors to accommodate the multiple add-in cards which wastes space on the motherboard and results in increased manufacturing costs since it takes time to install and solder each connector. The slots also takes space on the chassis that could be used for I/O.

It is therefore desirable to have an expansion slot design on the motherboard that saves board space, chassis space, and cost.

SUMMARY OF THE INVENTION

Briefly, the invention is concerned with a computer having a motherboard housed in a chassis. The motherboard has a socket with a manifold connector being mounted in the socket perpendicular to the motherboard. The manifold connector has multiple sockets that are mounted in a fan-like manner.

The invention has the advantage that it saves on motherboard space and costs.

The invention has the advantage that it allows space for I/O connectors to be attached to the manifold card connector structure.

DESCRIPTION OF THE PREFERRED EMBODIMENT

Figure 1:
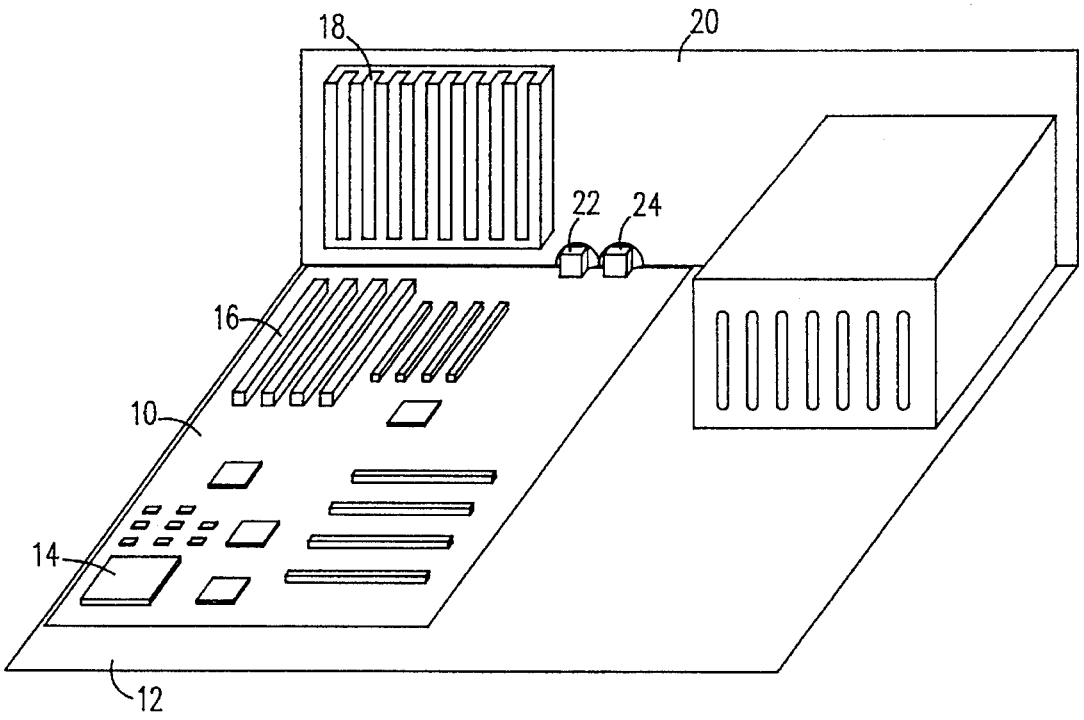
FIG. 1 PRIOR ART
FIG. 1 is a perspective view of a prior computer system motherboard.

Refer to FIG. 1 which is a perspective view of a prior art computer system. In the prior art, a large printed circuit board called a system board or motherboard (10), is fastened at the bottom of a computer chassis (12) and holds the computer's processor (14), control circuitry and other electronics. Eight expansion slots (16, 18) on the motherboard receive hardware options in the form of printed circuit cards that are plugged directly into one or more of the expansion slots. Each slot includes a connector, or socket (16) on the motherboard into which an expansion card is plugged. To hold the card rigidly in a vertical position each slot also has a bracket (18) on a back panel (20).

Input/output (I/O) devices, such as a video monitor, mouse and printer are connected to a back panel of the chassis by means of cables that plug into connectors (22, 24) through access holes in the back panel (20) of the chassis.

Figure 2:
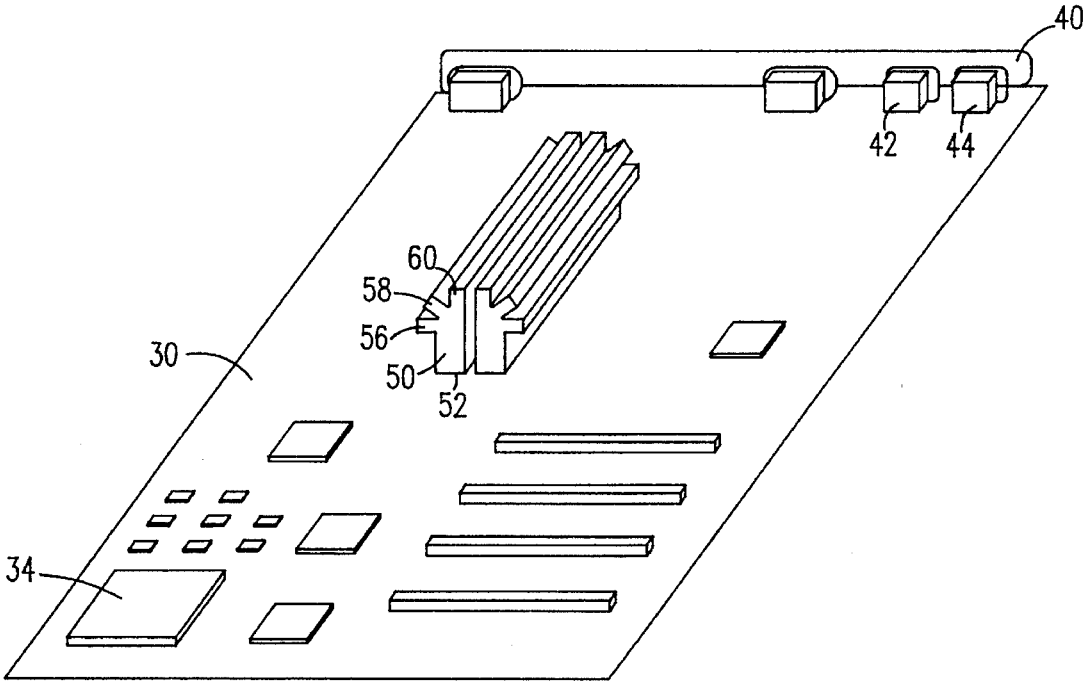
FIG. 2 is a perspective view of a computer system motherboard in which the present invention is embodied.

Refer to FIG. 2 which is a perspective view of a computer system motherboard in which the present invention is embodied. The invention is comprised of a single connector (50) that has card sockets (56, 58, 60) that fan out from a common base (50) that has a pin out (52) that is soldered into a motherboard (30).

Card edge connectors are commonly used for expansion in the PC industry. The typical 96-pin card edge connector is used for the PC/AT. Since this style of connector is readily available in several styles, for example (ISA, EISA, PCI, MicroChannel, and others)it has become very cost effective and is used in non-traditional applications. In one such application, an Extended Industry Architecture (EISA) connector has become the defacto standard for the riser connector on a motherboard to support both Industry Standard Architecture (ISA) and Peripheral Control Interface (PCI) bus protocol signals. The EISA connector supports 188 pins in 5.5 inches in-line. In order to support such cards, the manifold connector has enough pins out to the motherboard to handle cards of 188 pins each.

The invention has the advantage that only one or two connectors need to be to soldered into the motherboard. The invention accommodates three or more expansion cards per side and therefore saves on motherboard space and manufacturing cost. The invention has a further advantage that the design allows input/output (I/O) connectors to be located out of the back of the manifold.

Figure 3:
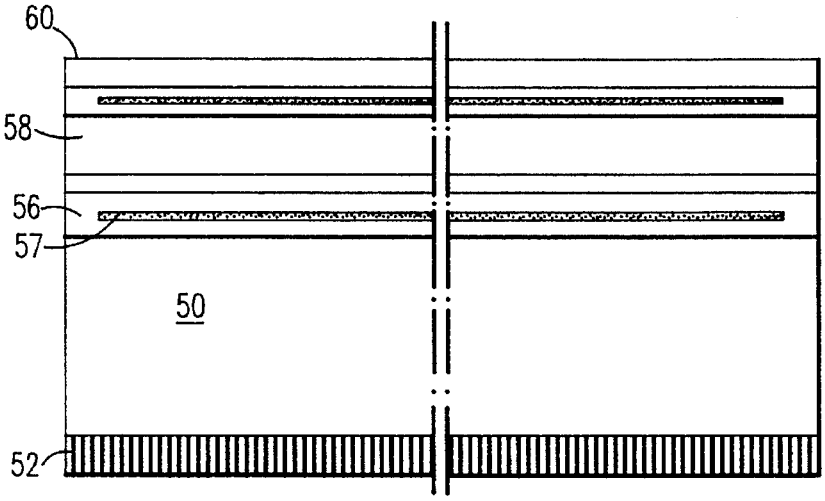
FIG. 3 is a side view of a three-card manifold card connector on the motherboard shown in FIG. 2.

Refer to FIG. 3 which is a front view of the three-card manifold card connector (50) on the motherboard (30) shown in FIG. 2. A computer expansion connector comprises a base (50) there being 188 pins (52) in the base. An upper portion (54) has three sockets (56, 58, 60) each socket having 188 connectors therein that are connected to the pins (52). A first socket (60) is oriented in a plane horizontal to the plane of the pins. A second socket (58) is oriented in a plane vertical to the plane of the pins. A third socket (58) is oriented in a plane at an angle, such as 45 degrees to the plane of the pins. Two of the connectors placed side by side provide for six add-in cards.

Figure 4:
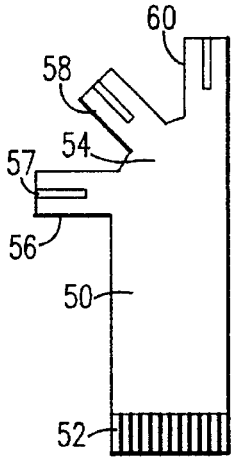
FIG. 4 is a front view cut-away of the three-card manifold card connector on the motherboard shown in FIG. 2.
Figure 5:
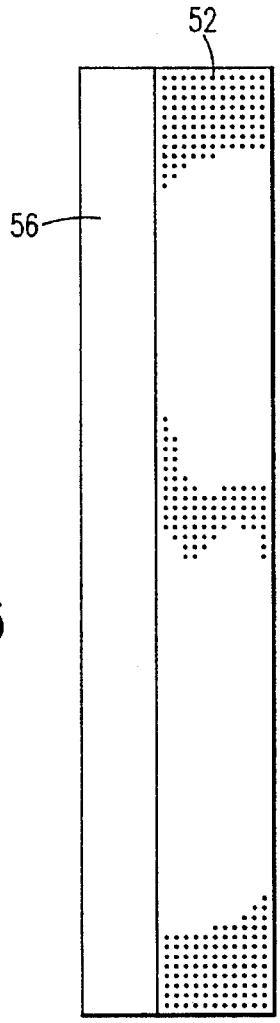
FIG. 5 is bottom view of the three-card manifold card connector shown in FIG. 3.

FIG. 4 is side view of the three-card manifold card connector shown in FIG. 3. FIG. 5 is bottom view of the three-card manifold card connector shown in FIG. 3.

Figure 6:
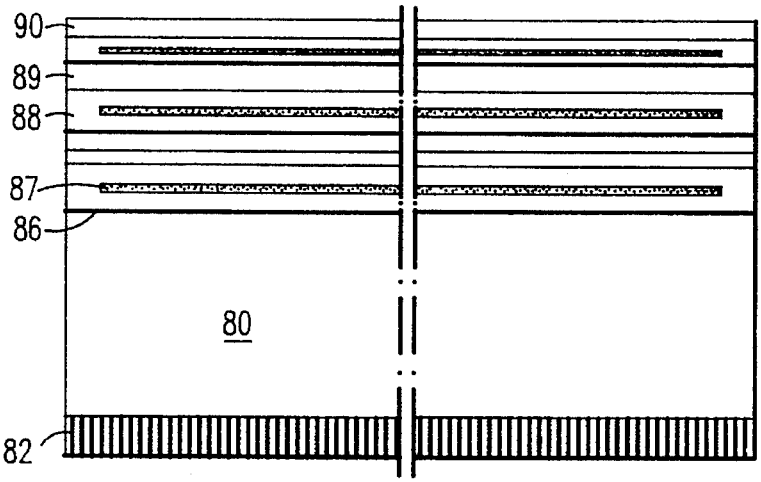
FIG. 6 is a side view of a four-card manifold card connector.

Refer to FIG. 6 which is a front view of a four-card manifold card connector (80). A computer expansion connector comprises a base (80) there being 188 pins (82) in the base. An upper portion (84) has four sockets (86, 88, 89, 90) each socket having 188 connectors therein that are connected to the pins (82). A first socket (86) is oriented in a plane horizontal to the plane of the pins. A second socket (88) is oriented in a plane at a 30 degree angle to the plane of the pins. A third socket (89) is oriented in a plane at a 60 degree angle to the plane of the pins. A fourth socket (90) is oriented in a plane vertical to the plane of the pins. Two of the connectors placed side by side provide for eight add-in cards.

Figure 7:
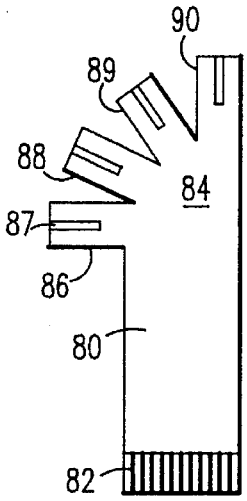
FIG. 7 is a front view in cut-away of the four-card manifold card connector of FIG. 6.
Figure 8:
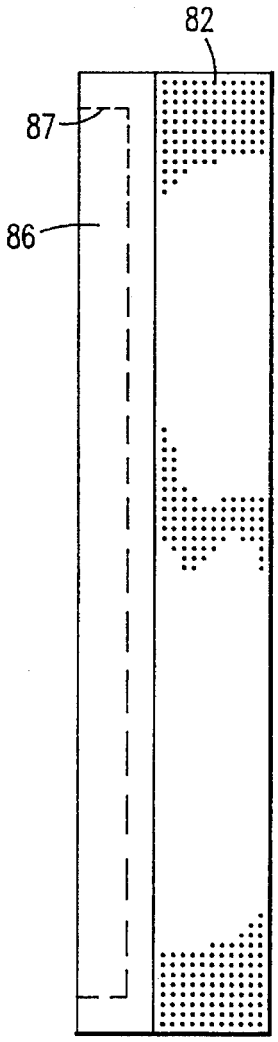
FIG. 8 is bottom view of the four-card manifold card connector shown in FIG. 6.

FIG. 7 is a side view cut away of the four-card manifold card connector of FIG. 6. FIG. 8 is a bottom view of the four-card manifold card connector of FIG. 6.

Those skilled in the art will understand that the total number of pins in the base of a manifold connector is 96 pins for connector cards conforming to the ISA standard. The total number of pins in the base of a manifold connector is 110 pins for connector cards conforming to the PCI standard. Two of the connectors placed side by side provide for six add-in cards in a computer that has two different buses, such as a PCI bus and an ISA bus. One of the manifold connectors plugs into a PCI bus socket and the other manifold connectors plugs into an ISA bus socket.

Figure 9:
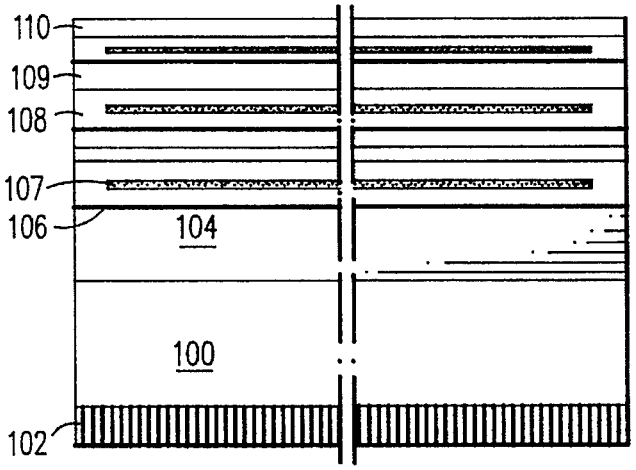
FIG. 9 is a side view of a seven-card manifold card connector.

Refer to FIG. 9. In a computer with a single bus, such as a PCI bus or an ISA bus, a single manifold expansion card connector provides for up to seven cards with a single 96 pin connector to an ISA bus or a single 110 pin connector to a PCI bus. A manifold expansion card connector comprises a base (100) there being 96, 110, or more pins (102) in the base. An upper portion (104) has seven sockets (106, 108, 109, 110, 112, 114, 116), each socket having connectors therein that are connected to the pins (102). A first socket (106) is oriented in a plane horizontal to the plane of the pins. A second socket (108) is oriented in a plane at a 30 degree angle to the plane of the pins. A third socket (109) is oriented in a plane at a 60 degree angle to the plane of the pins. A fourth socket (110) is oriented in a plane vertical to the plane of the pins The opposite side is similarly arranged. A fifth socket (112) is oriented in a plane at a 120 degree angle to the plane of the pins. A sixth socket (114) is oriented in a plane at a 150 degree angle to the plane of the pins. A seventh socket (116) is oriented in a plane at a 180 degree angle to the plane of the pins.

Figure 10:
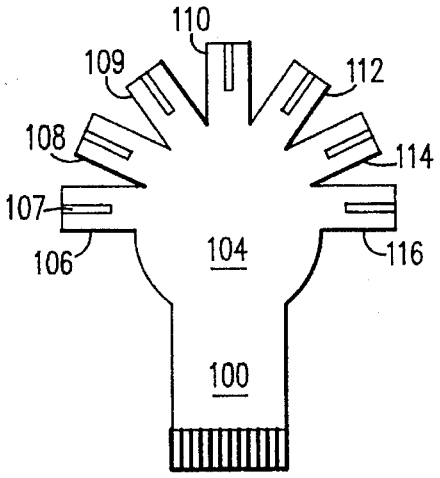
FIG. 10 is a front view in cut-away of the seven -card manifold card connector of FIG. 9.
Figure 11:
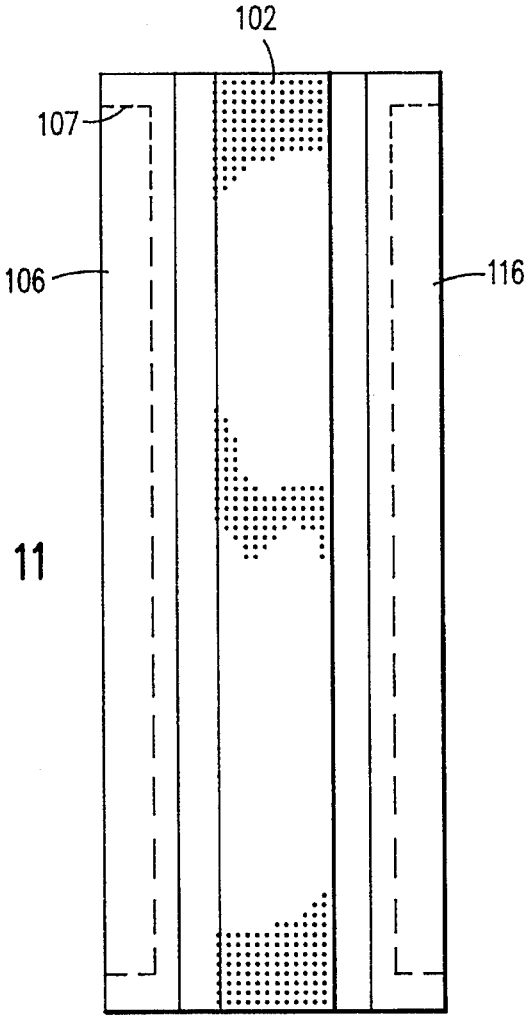
FIG. 11 is bottom view of the seven-card manifold card connector shown in FIG. 9.

FIG. 10 is a front view in cut-away of the seven-card manifold card connector of FIG. 9; and FIG. 11 is bottom view of the seven-card manifold card connector shown in FIG. 9.

While the invention has been particularly shown and described with reference to preferred embodiments thereof, it will be understood by those skilled in the art that the foregoing and other changes in form and detail may be made therein without departing from the scope of the invention.

What is claimed is:

1. A computer expansion connector comprising:

a base;

a number of male pins in said base;

said male pins being arranged in a horizontal plane;

an upper portion;

said upper portion comprising a number of sockets having connectors therein that are connected to said male pins;

a first socket of said number of sockets, said first socket being oriented in a first plane parallel to said horizontal plane;

a second socket of said number of sockets, said second socket being oriented in a second plane vertical to said horizontal plane; and, a third socket of said number of sockets, said third socket being oriented in a third plane, said third plane being at an angle to said horizontal plane.

2. The computer expansion connector in accordance with claim 1 wherein said angle is greater than zero and less than ninety degrees.

3. The computer expansion connector in accordance with claim 1 wherein said angle is thirty degrees.

4. The computer expansion connector in accordance with claim 1 wherein said angle is forty five degrees.

5. The computer expansion connector in accordance with claim 1 wherein said angle is sixty degrees.

6. A computer expansion connector comprising:

a base;

a number of male pins in said base;

said male pins being arranged in a horizontal plane;

an upper portion;

said upper portion comprising a number of sockets having connectors therein that are connected to said male pins;

a first socket of said number of sockets, said first socket being oriented in a first plane parallel to said horizontal plane;

a second socket of said number of sockets, said second socket being oriented in a second plane vertical to said horizontal plane;

a third socket of said number of sockets, said third socket being oriented in a third plane, said third plane being at a first angle to said horizontal plane, said first angle being greater than zero and equal to or less than forty five degrees; and, a fourth socket of said number of sockets, said fourth socket being oriented in a fourth plane, said fourth plane being at a second angle to said horizontal plane, said second angle being greater than forty five and less than ninety degrees.

7. The computer expansion connector in accordance with claim 6 wherein said first angle is thirty degrees.

8. The computer expansion connector in accordance with claim 6 wherein said first angle is forty five degrees.

9. The computer expansion connector in accordance with claim 6 wherein said second angle is sixty degrees.

10. The computer expansion connector in accordance with claim 6 wherein said first angle is thirty degrees and said second angle is sixty degrees.

11. The computer expansion connector in accordance with claim 6 wherein said first angle is forty five degrees and said second angle is sixty degrees.

12. A computer expansion connector comprising:

a base;

a number of male pins in said base;

said male pins being arranged in a horizontal plane;

an upper portion;

said upper portion comprising a number of sockets having connectors therein that are connected to said male pins;

a first socket of said number of sockets, said first socket being oriented in a first plane parallel to said horizontal plane;

a second socket of said number of sockets, said second socket being oriented in a second plane vertical to said horizontal plane;

a third socket of said number of sockets, said third socket being oriented in a third plane, said third plane being at a first angle to said horizontal plane, said first angle being greater than zero and less than ninety degrees; and, a fourth socket of said number of sockets, said fourth socket being oriented in a fourth plane, said fourth plane being at a second angle to said horizontal plane, said second angle being greater than ninety degrees and less than one-hundred eighty degrees.

13. The computer expansion connector in accordance with claim 12 wherein said first angle is thirty degrees.

14. The computer expansion connector in accordance with claim 12 wherein said first angle is forty five degrees.

15. The computer expansion connector in accordance with claim 12 wherein said first angle is sixty degrees.

16. The computer expansion connector in accordance with claim 12 wherein said second angle is one hundred twenty degrees.

17. The computer expansion connector in accordance with claim 12 wherein said second angle is one hundred twenty five degrees.

18. The computer expansion connector in accordance with claim 12 wherein said second angle is one hundred fifty degrees.

19. A computer comprising:

a motherboard having printed circuit wiring;

said motherboard being in a horizontal plane;

an expansion connector having a base and an upper portion;

said base being connected to said motherboard;

said upper portion comprising a number of sockets having connectors therein that are connected through said base to said printed circuit wiring;

a first socket of said number of sockets, said first socket being oriented in a first plane parallel to said horizontal plane;

a second socket of said number of sockets, said second socket being oriented in a second plane vertical to said horizontal plane; and, a third socket of said number of sockets, said third socket being oriented in a third plane, said third plane being at an angle to said horizontal plane.

20. The computer in accordance with claim 19 wherein said angle is greater than zero and less than ninety degrees.

21. The computer in accordance with claim 19 wherein said angle is thirty degrees.

22. The computer in accordance with claim 19 wherein said angle is forty five degrees.

23. The computer in accordance with claim 19 wherein said angle is sixty degrees.

24. A computer comprising:

a motherboard having printed circuit wiring;

said motherboard being in a horizontal plane an expansion connector having a base and an upper portion;

said base being connected to said motherboard;

said upper portion comprising a number of sockets having connectors therein that are connected through said base to said printed circuit wiring;

a first socket of said number of sockets, said first socket being oriented in a first plane parallel to said horizontal plane;

a second socket of said number of sockets, said second socket being oriented in a second plane vertical to said horizontal plane;

a third socket of said number of sockets, said third socket being oriented in a third plane, said third plane being at a first angle to said horizontal plane, said first angle being greater than zero and equal to or less than forty five degrees; and, a fourth socket of said number of sockets, said fourth socket being oriented in a fourth plane, said fourth plane being at a second angle to said horizontal plane, said second angle being greater than forty five and less than ninety degrees.

25. The computer in accordance with claim 24 wherein said first angle is thirty degrees.

26. The computer in accordance with claim 24 wherein said first angle is forty five degrees.

27. The computer in accordance with claim 24 wherein said second angle is sixty degrees.

28. The computer in accordance with claim 24 wherein said first angle is thirty degrees and said second angle is sixty degrees.

29. The computer in accordance with claim 24 wherein said first angle is forty five degrees and said second angle is sixty degrees.

30. A computer comprising:

a motherboard having printed circuit wiring;

an expansion connector having a base and an upper portion;

said base being connected to said motherboard;

said upper portion comprising a number of sockets having connectors therein that are connected through said base to said printed circuit wiring;

a first socket of said number of sockets, said first socket being oriented in a first plane parallel to said horizontal plane;

a second socket of said number of sockets, said second socket being oriented in a second plane vertical to said horizontal plane;

a third socket of said number of sockets, said third socket being oriented in a third plane, said third plane being at a first angle to said horizontal plane, said first angle being greater than zero and less than ninety degrees; and, a fourth socket of said number of sockets, said fourth socket being oriented in a fourth plane, said fourth plane being at a second angle to said horizontal plane, said second angle being greater than ninety degrees and less than one-hundred eighty degrees.

31. The computer in accordance with claim 30 wherein said first angle is thirty degrees.

32. The computer in accordance with claim 30 wherein said first angle is forty five degrees.

33. The computer in accordance with claim 30 wherein said first angle is sixty degrees.

34. The computer in accordance with claim 30 wherein said second angle is one hundred twenty degrees.

35. The computer in accordance with claim 30 wherein said second angle is one hundred twenty five degrees.

36. The computer in accordance with claim 30 wherein said second angle is one hundred fifty degrees.

37. A computer expansion connector comprising:

a base;

a number of male pins in said base;

said male pins being arranged in a horizontal plane;

an upper portion;

said upper portion comprising a number of sockets having connectors therein that are connected to said male pins;

a first socket of said number of sockets, said first socket being oriented in a first plane parallel to said horizontal plane;

a second socket of said number of sockets, said second socket being oriented in a second plane vertical to said horizontal plane;

a third socket of said number of sockets, said third socket being oriented in a third plane, said third plane being at an angle of thirty degrees to said horizontal plane;

a fourth socket of said number of sockets, said fourth socket being oriented in a fourth plane, said fourth plane being at an angle of forty five degrees to said horizontal plane; and, a fifth socket of said number of sockets, said fifth socket being oriented in a third plane, said fifth plane being at an angle of sixty degrees to said horizontal plane.

38. A computer comprising:

a motherboard having printed circuit wiring;

an expansion connector having a base and an upper portion;

said base being connected to said motherboard;

said upper portion comprising a number of sockets having connectors therein that are connected through said base to said printed circuit wiring;

a first socket of said number of sockets, said first socket being oriented in a first plane parallel to said horizontal plane;

a second socket of said number of sockets, said second socket being oriented in a second plane vertical to said horizontal plane;

a third socket of said number of sockets, said third socket being oriented in a third plane, said third plane being at an angle of thirty degrees to said horizontal plane;

a fourth socket of said number of sockets, said fourth socket being oriented in a fourth plane, said fourth plane being at an angle of forty five degrees to said horizontal plane; and, a fifth socket of said number of sockets, said fifth socket being oriented in a third plane, said fifth plane being at an angle of sixty degrees to said horizontal plane.

* * * * *

UNITED STATES PATENT AND TRADEMARK OFFICE

CERTIFICATE OF CORRECTION

PATENT NO. : 5,558,522

DATED : September24, 1996

INVENTOR(S) : David Dent

It is certified that error appears in the above-identified patent and that said Letters Patent is hereby corrected as shown below:

Column 3, line 9, change "socket (60) to -- socket (56) --;
Column 3, line 10, change "socket (58) to -- socket (60) --;

Signed and Sealed this

Third Day of December, 1996

*Attest:*

Bruce Lehman

BRUCE LEHMAN

*Attesting Officer*

*Commissioner of Patents and Trademarks*